United States Patent [19]

Kjölsrud

[11] 4,091,850

[45] May 30, 1978

[54] APPARATUS FOR ATTACHING ROOF INSULATING SHEETS AND SIMILAR OBJECTS

[76] Inventor: Birger Kjölsrud, Pianogatan 16, S-421 44 Västra Frölunda, Sweden

[21] Appl. No.: 706,493

[22] Filed: Jul. 19, 1976

[30] Foreign Application Priority Data

Jul. 23, 1975 Sweden ..... 750833

[51] Int. Cl.[2] ..... B25B 23/00

[52] U.S. Cl. ..... 144/32 R; 29/240; 227/112; 227/120

[58] Field of Search ..... 29/200 H, 211 R, 211 M, 29/212 R, 240, 432; 227/18, 120, 76, 16, 93, 111, 112; 144/32

[56] References Cited

U.S. PATENT DOCUMENTS

| | | | |
|---|---|---|---|
| 2,886,815 | 5/1959 | Young | 227/120 |
| 3,279,045 | 10/1966 | Dixon | 29/240 X |
| 3,581,370 | 6/1971 | Passarella | 144/32 |
| 3,595,460 | 7/1971 | Pitkin | 227/112 X |
| 3,734,377 | 5/1973 | Munn | 227/120 |
| 3,935,983 | 2/1976 | Buttriss | 227/120 X |

*Primary Examiner*—Othell M. Simpson
*Assistant Examiner*—W. D. Bray
*Attorney, Agent, or Firm*—Harness, Dickey & Pierce

[57] ABSTRACT

An apparatus designed to attach sheets, preferably insulating sheets of e.g. mineral wool to an underlying layer, such as profiled sheet metal, by using centrally apertured washers and screws that are driven through the washer and the insulating sheet and into the underlying layer, thus securing the insulating sheet thereto. The apparatus which is run across the insulating sheet, comprises means for feeding the washers, one at a time, to the desired points of attachment on the sheet, means for time and place controlled feeding of screws to the washers already deposited in place, and a drill means arranged to engage said screws so as to drive them down, through the insulating sheet and into the underlying layer.

7 Claims, 3 Drawing Figures

APPARATUS FOR ATTACHING ROOF INSULATING SHEETS AND SIMILAR OBJECTS

BACKGROUND OF THE INVENTION

For a number or reasons, layers of insulating materials in the form of e.g. sheets of mineral wool, instead of being glued to the underlying layer or substratum which may consist of profiled sheet metal, are nowadays more often attached to the support with the aid of washers and screws. The work of securing sheets of this kind with the aid of washers and screws is, however, a tedious and time-consuming one as the workman must stoop down and deposit the washers along a demarkation line and thereafter tighten the screws, which in turn requires the use of some kind of tool which is moved into engagement with the screw heads.

SUMMARY OF THE INVENTION

The present invention aims at providing an apparatus by means of which this work is greatly facilitated, and more precisely it concerns an apparatus designed to attach preferably insulating sheets of e.g. mineral wool to an underlying layer or substratum which may consist of for instance profiled sheet metal, with the use of washers and screws. The apparatus in accordance with the invention comprises a frame arranged to be driven across the substratum and carrying means arranged to feed washers to the points of attachment, a tube or similar object feeding one screw at a time to the associated washer which has been positioned in place at the point of attachment, and means arranged to drive the screw through a centre aperture formed in the washer, down into and through the insulating material and home into the substratum.

Another object of the invention is to provide an apparatus of the kind referred to wherein the means feeding the washers consists of a tube-like member having a flattened cross-sectional configuration corresponding to that of the washers.

A still further object of the invention is to provide an apparatus of the kind referred to wherein said screw driving means is a drill rod guided in a tube and having its one and designed in a manner permitting it to be interconnected with a drilling machine whereas the opposite rod end is shaped to allow engagement with the head of the screw. The drill rod is displaceable over a limited length in its longitudinal direction, whereby the rod may also serve as a control means upon feeding of the screws through the guide tube secured to the tube.

A further object of the invention is to provide an apparatus of the kind referred to wherein the frame is in the form of a slab which may be driven across the surface of the insulating sheet, preferably on wheels. Above the working area the slab is provided with a see-through window plate permitting supervision of the operation of the apparatus.

In accordance with the invention the frame slab may have guide marks or similar means provided thereon for guidance of the movements of the frame across the sheet of insulating material.

Further characteristics and advantages gained by the invention will become apparent upon reading of the following description of a preferred embodiment.

BRIEF DESCRIPTION OF THE DRAWINGS

The invention will be described in more detail in the following with reference to the accompanying drawings, wherein.

DETAILED DESCRIPTION OF A PREFERRED EMBODIMENT

Figure 1:
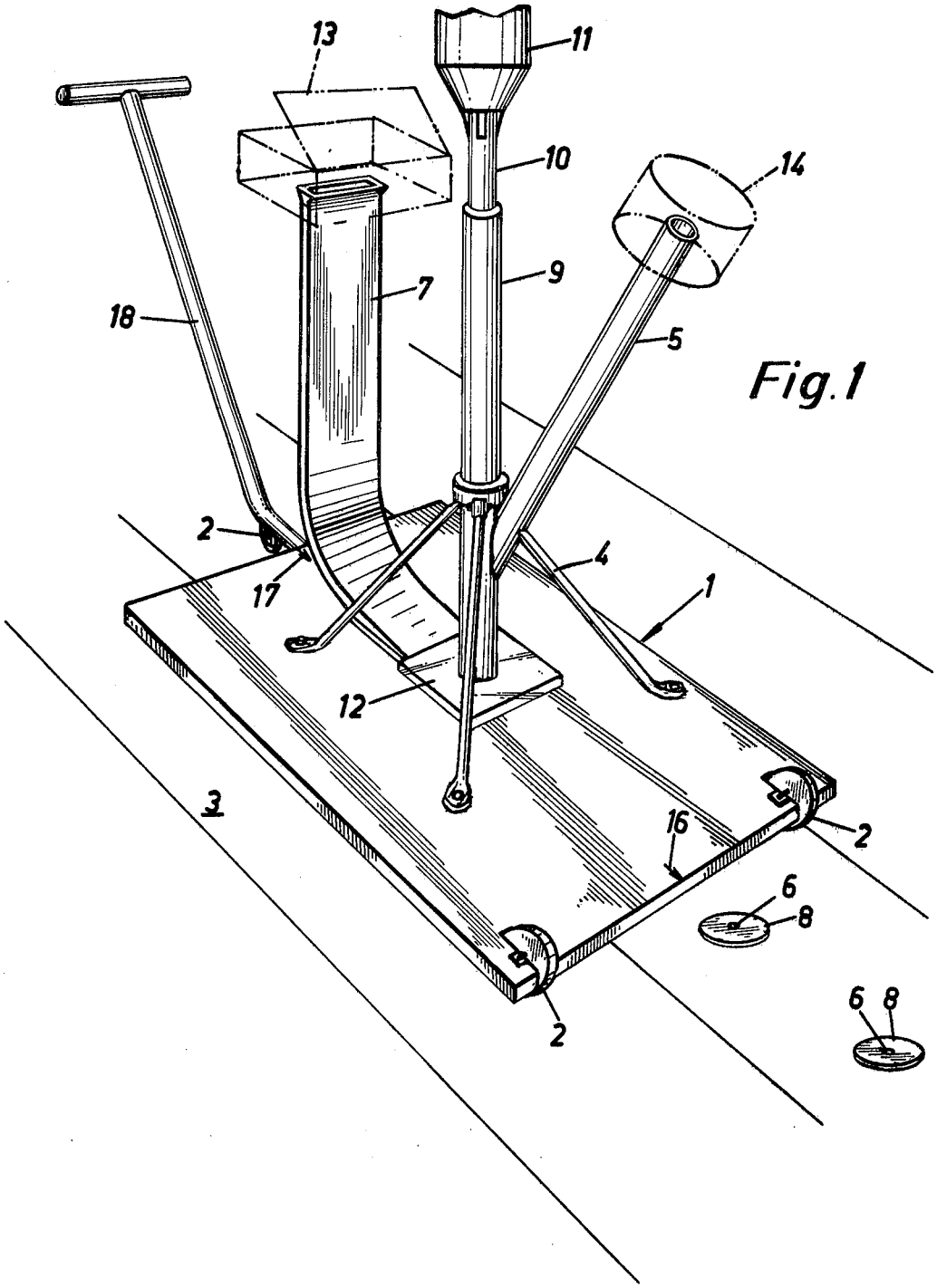
FIG. 1 is a perspective view of the apparatus in accordance with the invention in position of use.
Figure 2:
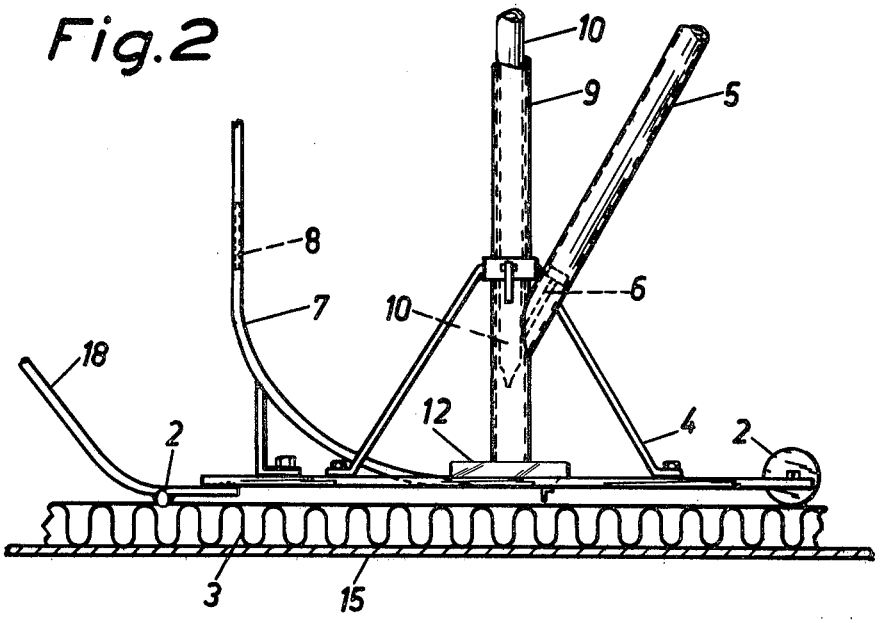
FIG. 2 is a lateral view, shown partly in section, of the apparatus during one phase of its operation.
Figure 3:
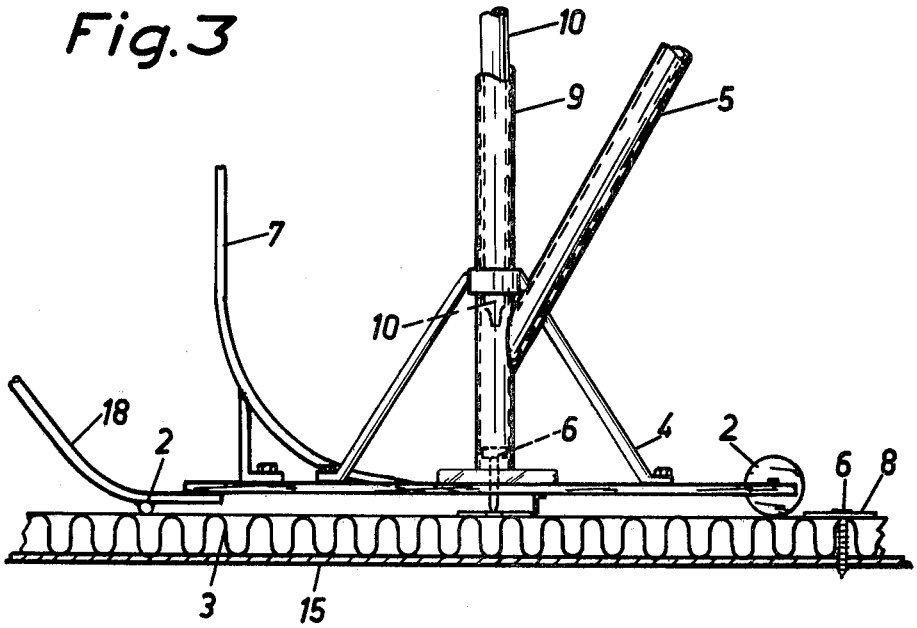
FIG. 3 is a section similar to that of FIG. 2 but illustrating a different phase of the operation of the apparatus.

The apparatus in accordance with the invention comprises a frame 1, preferably in the form of a slab which is displaceable on wheels 2 across the surface of the insulating material 3 to be secured. With the aid of supports 4 the frame 1 carries a tube 5 designed to feed screws 6. The frame 1 also supports a second tube 7 which is flattened into a rectangular, channel-like configuration and designed to feed washers 8. Furthermore, a guide tube 9 is mounted on the frame 1 so as to guide a drill rod 10 which may be connected to a drilling machine 11. The channel-like tube 7 discharges in a recess formed beneath a plate 12 in the frame at the point where the insulating sheet 3 is to be secured, whereby is ensured that washers 8 when fed from a supply 13 to the desired points of attachment will assume the correct position for abutment against the substratum. The drill rod 10 is maintained in its lower position (see FIG. 2) by a spring or similar means so as to prevent screws 6 which are fed through the tube 5 from the supply 14 from being conveyed to the point of attachment too early. When the drill rod 10 is retracted, i.e. pulled upwards (FIG. 3) the mouth of the pipe 5 is exposed and a screw 6 allowed to fall down into position of attachment exactly opposite the centre aperture in the washer 8.

At its lower end the drill rod 10 is shaped so as to allow it to engage in a slit, star-shaped groove or the like formed in the head of the screw 6 whereby the screw may easily and rapidly be driven home with the aid of a drilling machine 11, through the insulating mat 3 and into engagement with the supporting surface 15 which may be profiled sheet metal or some similar material.

To direct the apparatus in accordance with the invention an awl mark may be applied on the insulating material and signs or marks 16, 17 be provided on the frame slab to assist in guiding the apparatus. To facilitate displacement of the apparatus the frame 1 may be equipped with a handle 18.

The invention is not limited to the embodiment as described and illustrated but various modifications thereof are possible within the scope of the appended claims. For instance, the plate 12 may be made from transparent material so as to provide a possibility to supervise the operation of the apparatus. Inside the tube 9 it is preferred to apply some kind of blocking shoulder or abutment preventing the drill 10 from being pulled too far upwards. Likewise, the provision of adjustable abutment means is conceivable to allow for various lengths of the screws 6 to fit insulating materials of various thicknesses. The feeding channels 5 and 7 may have cross-sectional shapes different from those illustrated.

What I claim is:

1. An improved apparatus for attaching sheets, such as insulating sheets of mineral wool to a substratum, such as profiled sheet metal, by using centrally apertured washers and screws, the improvement comprising a portable flat frame adapted to be conveyed across said substratum, said frame carrying washer gravity feed means attached to and extending upwardly therefrom for sequentially feeding washers to the points of attachment, a tube-like screw gravity feed means attached to said frame and extending upwardly therefrom for feeding one screw at a time to a washer deposited in place by said washer gravity feed means at the points of attachment, and means carried by said frame and arranged to drive said screws through said centre aperture formed in said washers, down into and through said insulating material and into said substratum.

2. An improved apparatus according to claim 1, wherein said washer-feeding means is a tube-like member having a flattened cross-sectional configuration corresponding to the cross sectional configuration of said washers.

3. An improved apparatus according to claim 1, wherein said means driving screws is a drill rod, said drill rod being guided in a tube affixed to the frame one end of said drill rod being shaped for connection to a drilling machine and the opposite end of said drill rod being shaped so as to allow said drill rod end to engage the heads of said screws.

4. An improved apparatus according to claim 3, wherein said tube is intersected by said screw gravity feed means for delivery of the screws from said screw gravity feed means to said tube, said drill rod being mounted for limited displacement in its longitudinal direction along said tube, movement of said drill rod along said tube allowing said drill rod to serve as a control means controlling the feeding of said screws through said tube from said screw gravity feed means.

5. An improved apparatus according to claim 1, wherein said frame is in the form of a slab, said slab carried by wheels for being driven across the surface of said insulating sheet.

6. An improved apparatus according to claim 5, wherein said slab is formed with a transparent plate mounted above the working area so as to permit visual supervision of the operation of said apparatus.

7. An improved apparatus according to claim 1, wherein indications such as guide marks are provided on said frame slab to guide the movements of said frame across said insulating sheet.

* * * * *

UNITED STATES PATENT AND TRADEMARK OFFICE

CERTIFICATE OF CORRECTION

PATENT NO. : 4,091,850

DATED : May 30, 1978

INVENTOR(S) : Birger Kjolsrud

It is certified that error appears in the above-identified patent and that said Letters Patent are hereby corrected as shown below:

Column 1, line 46, "and" should be --end--.

Column 2, line 62, after "drill" insert --rod--.

Column 3, line 19, cancel "feeding" and substitute --gravity feed--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*